US008038278B2

(12) United States Patent
Takagi

(10) Patent No.: US 8,038,278 B2
(45) Date of Patent: Oct. 18, 2011

(54) INK CARTRIDGES

(75) Inventor: Yuki Takagi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 506 days.

(21) Appl. No.: 12/326,019

(22) Filed: Dec. 1, 2008

(65) Prior Publication Data

US 2009/0141104 A1 Jun. 4, 2009

(30) Foreign Application Priority Data

Nov. 30, 2007 (JP) ..... 2007-311816

(51) Int. Cl.
*B41J 2/17* (2006.01)

(52) U.S. Cl. ..... 347/86; 347/85; 347/87

(58) Field of Classification Search ..... 347/85–87
See application file for complete search history.

(56) References Cited

U.S. PATENT DOCUMENTS

| | | | | |
|---|---|---|---|---|
| 6,460,984 | B1 * | 10/2002 | Matsumoto et al. | 347/86 |
| 7,628,478 | B2 * | 12/2009 | Inoue | 347/85 |
| 7,712,475 | B2 * | 5/2010 | Fukuda et al. | 134/94.1 |
| 7,815,299 | B2 * | 10/2010 | Kanbe | 347/86 |
| 2006/0274129 | A1 * | 12/2006 | Lee et al. | 347/85 |
| 2007/0070147 | A1 | 3/2007 | Hattori et al. | |

FOREIGN PATENT DOCUMENTS

JP 2007144808 A 6/2007

* cited by examiner

*Primary Examiner* — Ellen Kim
(74) *Attorney, Agent, or Firm* — Baker Botts L.L.P.

(57) ABSTRACT

An ink cartridge includes a case including an ink chamber configured to store ink therein, and a particular face facing an exterior of the case and having a first opening formed therethrough. The ink cartridge also includes an ink supply portion extending from a particular portion of the particular face in a particular direction, in which the particular portion surrounds the first opening, and the ink supply portion has a tube shape. The ink supply portion includes a particular chamber formed therein, an end wall having a second opening formed therethrough, and a peripheral wall extending from the end wall. The ink supply portion is configured to supply ink from the ink chamber to the exterior of the case via the particular chamber and the second opening.

7 Claims, 11 Drawing Sheets

INK CARTRIDGES

CROSS-REFERENCE TO RELATED APPLICATION

The present application claims priority from Japanese Patent Application No. JP-2007-311816, which was filed on Nov. 30, 2007, the disclosure of which is incorporated herein by reference in its entirety.

BACKGROUND OF THE INVENTION

1. Field of the Invention

The present invention relates generally to ink cartridges configured to be used in an image recording apparatus. More specifically, the present invention is directed towards ink cartridges comprising an ink supply portion and an ink holding portion formed at the ink supply portion.

2. Description of Related Art

A known ink-jet image recording apparatus has a recording head and an ink supply device configured to supply ink to the recording head. A known ink cartridge is configured to be mounted to the ink supply device. The known ink cartridge has a case, and the case has an ink chamber formed therein. The ink chamber is configured to store ink therein. The known ink cartridge also has an ink supply portion, and ink is supplied from an interior of the ink chamber to an exterior of the ink chamber via the ink supply portion. When the known ink cartridge is mounted to the ink supply device, ink stored in the ink chamber is supplied to the recording head via the ink supply portion. The recording head is configured to selectively eject ink toward a sheet of paper, such that an image is recorded on the sheet.

Another known ink cartridge, such as the ink cartridge described in JP-A-2007-144808, has an ink supply portion having a tube-shaped wall extending from a particular face of a case of the ink cartridge. The ink supply portion also has an elastic member positioned at the end of the tube-shaped wall. The elastic member has an opening formed therein. When the another known ink cartridge is mounted to the ink supply device, an ink tube of the ink supply device is inserted into the opening of the elastic member. When this occurs, the elastic member is configured to elastically deform and to contact the outer surface of the ink tube liquid-tightly. The ink supply portion also has a cap, and the elastic member is sandwiched between the end of the tube-shaped wall and the cap while the elastic member is elastically deformed. The cap has an end wall having an opening formed therein, and a peripheral wall covering a portion of the elastic member and a portion of the tube-shaped wall. When the another known ink cartridge is mounted to the ink supply device, the ink tube is inserted into the opening of the cap and then into the opening of the elastic member. The ink supply portion further has a valve element and a spring positioned in the tube-shaped wall. The spring biases the valve element toward the elastic member. When the another known ink cartridge is not mounted to the ink supply device, the valve element contacts the elastic member and covers the opening of the elastic member while being biased by the spring. When the ink tube of the ink supply device is inserted into the opening of the elastic member, the ink tube contacts and pushes the valve element against the biasing force of the spring, such that the valve element moves away from the elastic member. As such, ink is supplied from the interior of the ink chamber to the exterior of the ink chamber via the ink tube.

When the another known ink cartridge is mounted to and removed from the ink supply device, ink may leak from the ink supply portion or the ink tube, or both, and the leaked ink may adhere to the outer surface of the cap. When the another known ink cartridge is repeatedly mounted to and removed from the ink supply device, such leaked ink may drip from the ink cartridge.

SUMMARY OF THE INVENTION

Therefore, a need has arisen for ink cartridges which overcome these and other shortcomings of the related art. A technical advantage of the present invention is that ink is prevented from dripping from an ink cartridge.

According to an embodiment of the present invention, an ink cartridge comprises a case comprising an ink chamber configured to store ink therein, and a particular face facing an exterior of the case and having a first opening formed therethrough. The ink cartridge also comprises an ink supply portion extending from a particular portion of the particular face in a particular direction, in which the particular portion surrounds the first opening, and the ink supply portion has a tube shape. The ink supply portion comprises a particular chamber formed therein, an end wall having a second opening formed therethrough, and a peripheral wall extending from the end wall. The ink supply portion is configured to supply ink from the ink chamber to the exterior of the case via the particular chamber and the second opening. Moreover, the ink cartridge comprises a plurality of protrusions. Each of the plurality of protrusions extend from the peripheral wall in a corresponding radial direction with respect to the peripheral wall, and extends in an axial direction of the peripheral wall. Each corresponding radial direction is perpendicular to the axial direction of the peripheral wall, and the axial direction of the peripheral wall is parallel to the particular direction. Moreover, each adjacent pair of the plurality of protrusions defines an ink holding space therebetween, and the ink holding space has a first end and a second opposite the first end, in which the first end is positioned closer to the end wall than the second end is positioned to the end wall, and the ink holding space is open at the first end.

According to another embodiment of the present invention, an ink cartridge comprises a case comprising an ink chamber configured to store ink therein, a first face facing an exterior of the case and having a first opening formed therethrough, a second face facing the exterior of the case and positioned opposite the first face, a third face facing the exterior of the case and extending between the first face and the second face, and a fourth face facing the exterior of the case and extending between the first face and the second face. The fourth face is positioned opposite the third face, and the first opening is positioned closer to the fourth face than the first opening is positioned to the third face. The ink cartridge also comprises an ink supply portion extending from a particular portion of the particular face in a particular direction, in which the particular portion surrounds the first opening, and the ink supply portion has a tube shape. The ink supply portion comprises a particular chamber formed therein, an end wall having a second opening formed therethrough, and a peripheral wall extending from the end wall, in which the ink supply portion is configured to supply ink from the ink chamber to the exterior of the case via the particular chamber and the second opening. Moreover, the ink cartridge comprises a plurality of protrusions, in which each of the plurality of protrusions extend from the peripheral wall in a corresponding radial direction with respect to the peripheral wall, and extend in an axial direction of the peripheral wall. Each corresponding radial direction is perpendicular to the axial direction of the peripheral wall, and the axial direction of the peripheral wall is parallel to the particular direction, in which each adjacent pair of the plurality of protrusions defines an ink holding space therebetween, and the ink holding space has a first end and a second opposite the first end. Moreover, the first end is positioned closer to the end wall than the second end is positioned to the end wall, and the ink holding space is open at the first end and is positioned between the particular chamber and a plane on which the fourth face lies.

Other objects, features, and advantages of embodiments of the present invention will be apparent to persons of ordinary skill in the art from the following description of embodiments with reference to the accompanying drawings.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS

Embodiments of the present invention and their features and technical advantages may be understood by referring to FIGS. 1-11, like numerals being used for like corresponding portions in the various drawings.

Figure 1B:
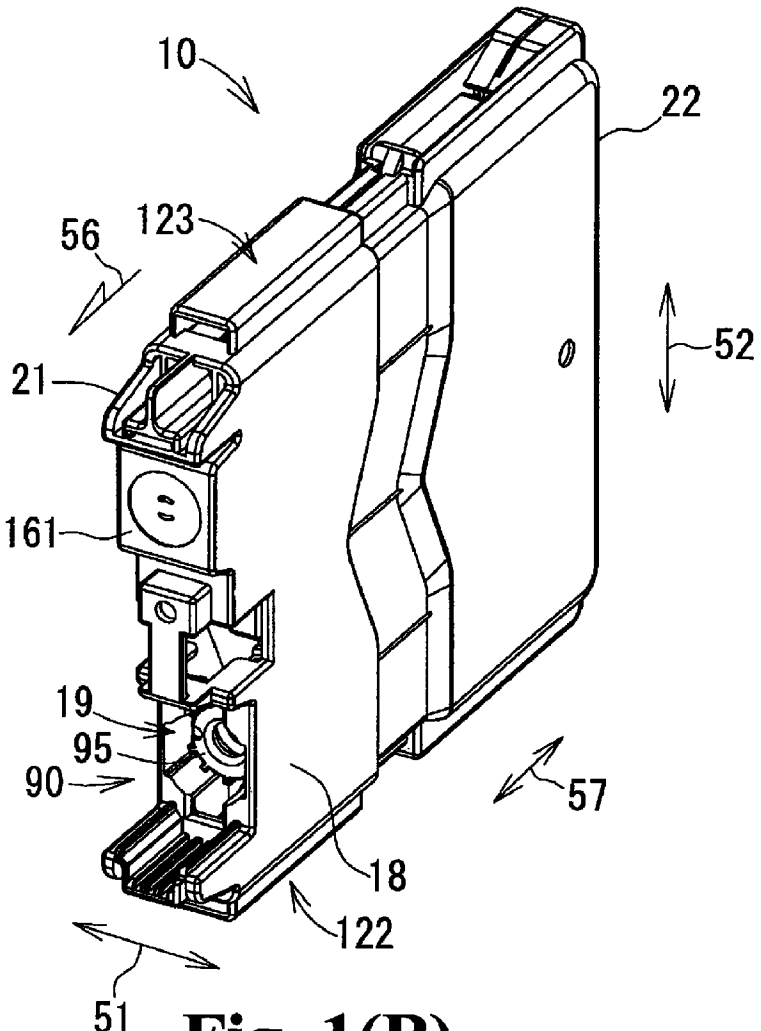
FIGS. 1(A) and 1(B) are perspective views of an ink cartridge according to an embodiment of the present invention, in which a first cover of the ink cartridge is in a second position and a first position, respectively.
Figure 1A:
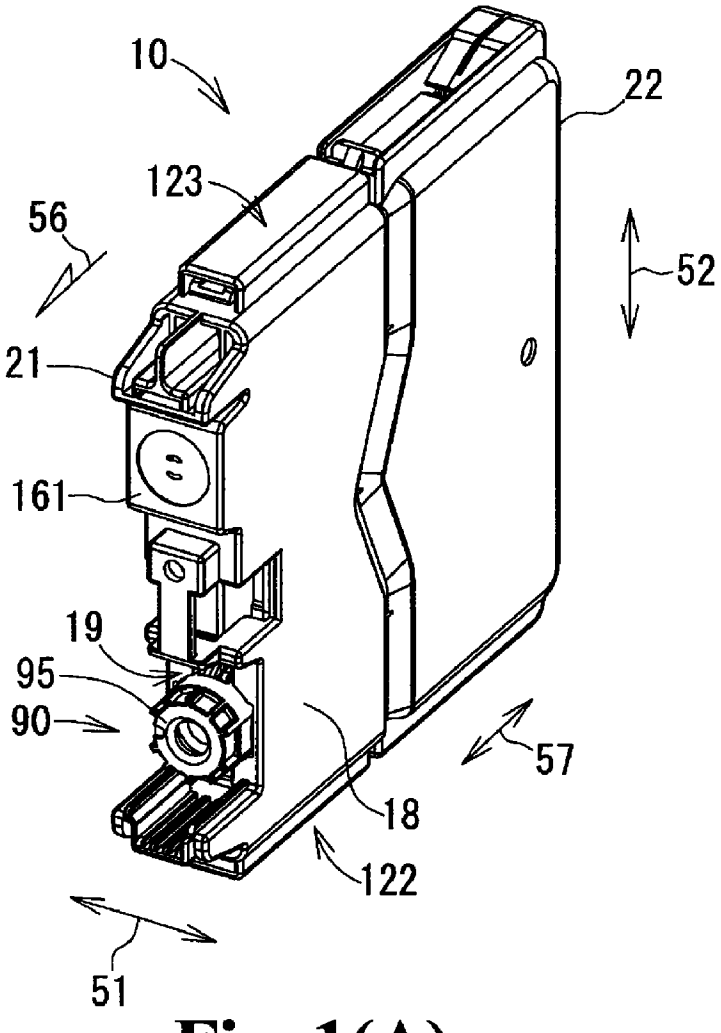
Figure 2A:
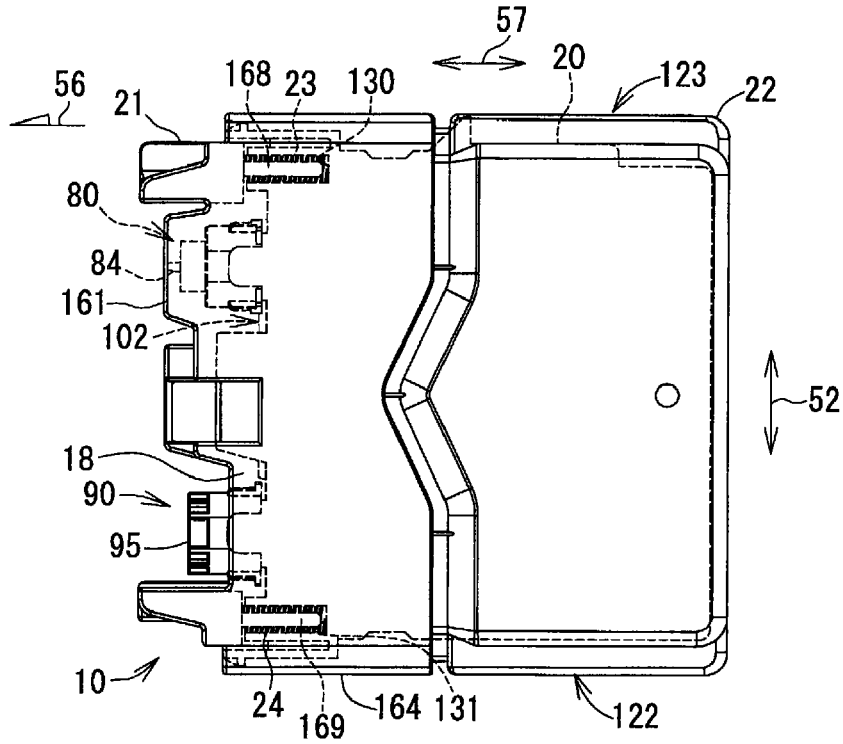
FIGS. 2(A) and 2(B) are side views of the ink cartridge of FIGS. 1(A) and 1(B), respectively.
Figure 2B:
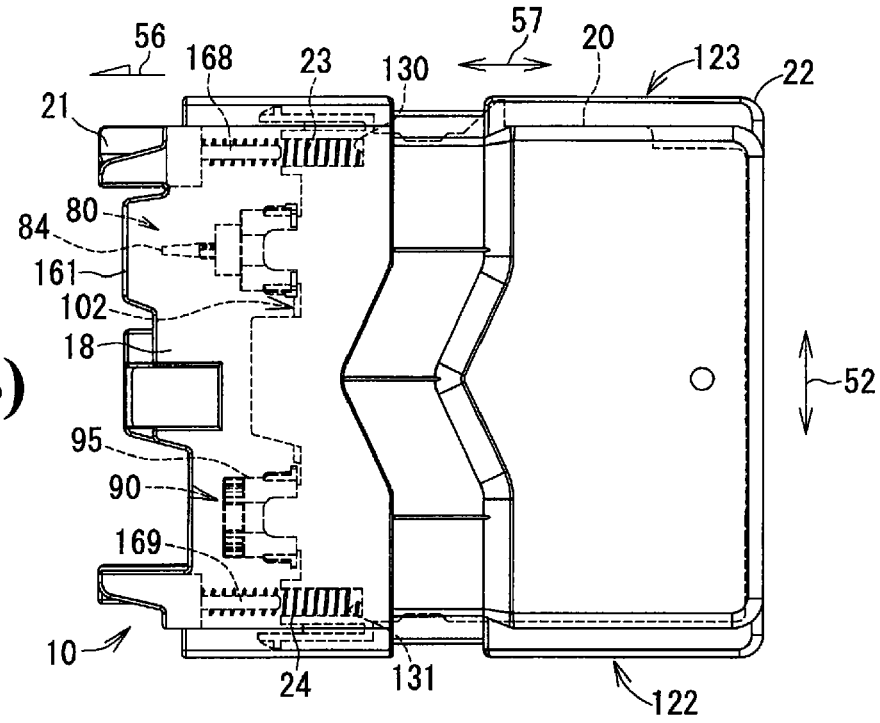
Figure 3:
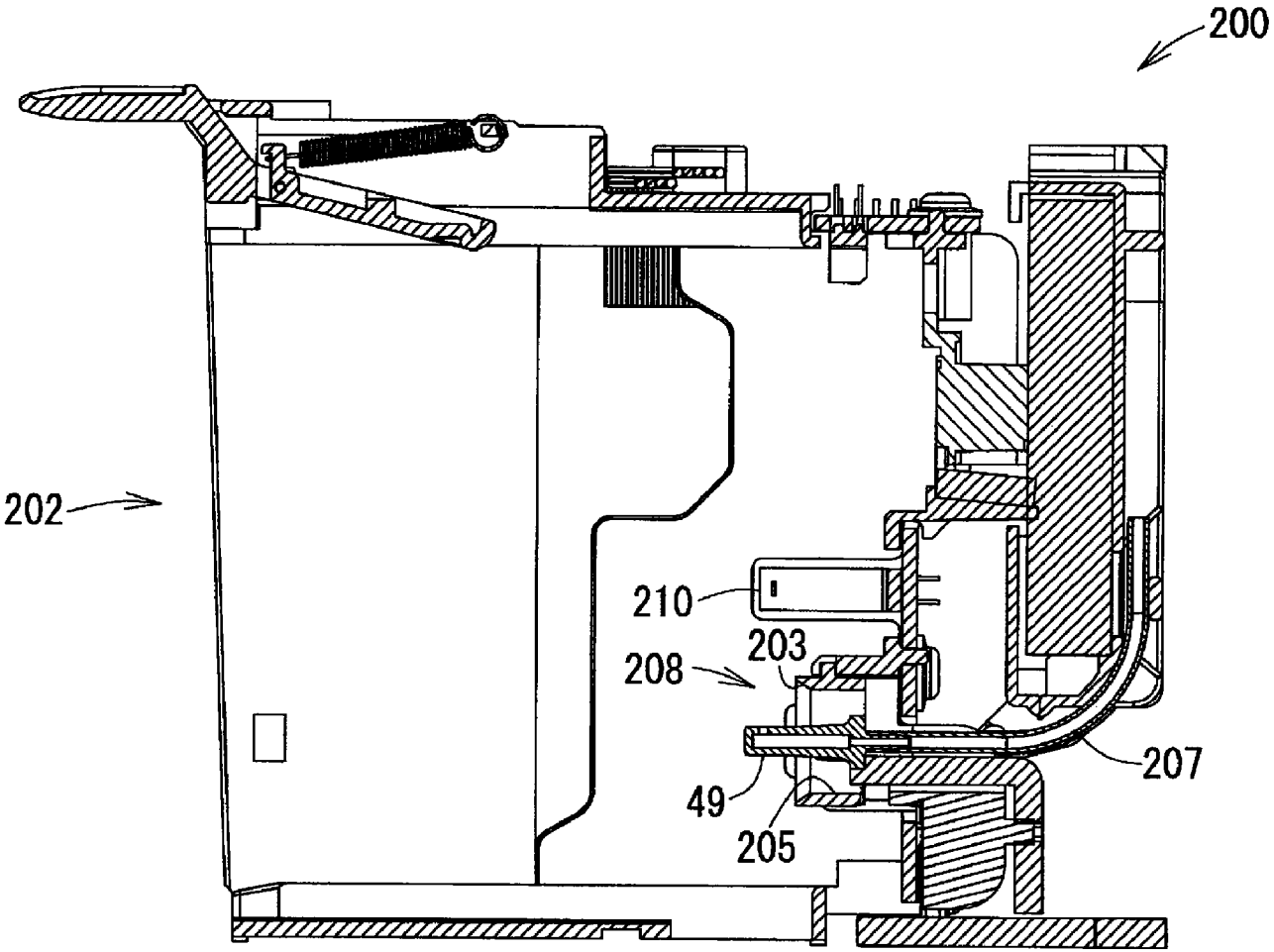
FIG. 3 is a vertical cross-sectional view of a mounting portion according to an embodiment of the present invention.

Referring to FIGS. 1(A)-2(B) and 4-5, an ink cartridge 10 according to an embodiment of the present invention is described. Ink cartridge 10 may be configured to be used with an ink-jet image recording apparatus (not shown). Referring to FIG. 3, the ink-jet image recording apparatus may comprise a recording head (not shown) and an ink supply device 200 configured to supply ink to the recording head (not shown). Ink supply device 200 may comprise a mounting portion 202, and ink cartridge 10 may be configured to removably mounted to mounting portion 202. Mounting portion 202 may comprise an ink tube 49. Ink tube 49 may comprise a resin material, and may be connected to a flexible tube 207. Flexible tube may be connected to the recording head. When ink cartridge 10 is mounted to mounting portion 202, ink may be supplied from ink cartridge 10 to the recording head via ink tube 49 and flexible tube 207.

Ink cartridge 10 may have a flattened, substantially rectangular parallelepiped shape having a width in a width direction 51, a height in a height direction 52, and a depth in a depth direction 57. The width of ink cartridge 10 may be less than each of the height of ink cartridge 10 and the depth of ink cartridge.

Ink cartridge 10 may be inserted into mounting portion 202 in an insertion direction 56, which is parallel to depth direction 57. Ink cartridge 10 may comprise a top face 123 and a bottom face 122 opposite top face 123. When ink cartridge 10 is mounted to mounting portion 202, ink cartridge 10 is in a position depicted in FIGS. 1(A)-2(B), i.e., top face 123 is positioned at the top of ink cartridge 10, and bottom face 122 is positioned at the bottom of ink cartridge 10.

Ink cartridge 10 may comprise a case 20, a first cover 21, a second cover 22, and coil springs 23 and 24. First cover 21 and second cover 22 may define substantially an entirety of the outer appearance of ink cartridge 10. Case 20 may comprise ink chamber 100 formed therein, and ink chamber 100 may be configured to store ink therein. First cover 21 and second cover 22 may enclose substantially the entirety of case 20. In an embodiment, case 20, first cover 21, and second cover 22 may comprise resin material such, as nylon, polyethylene, polypropylene, or any combination thereof.

Figure 4:
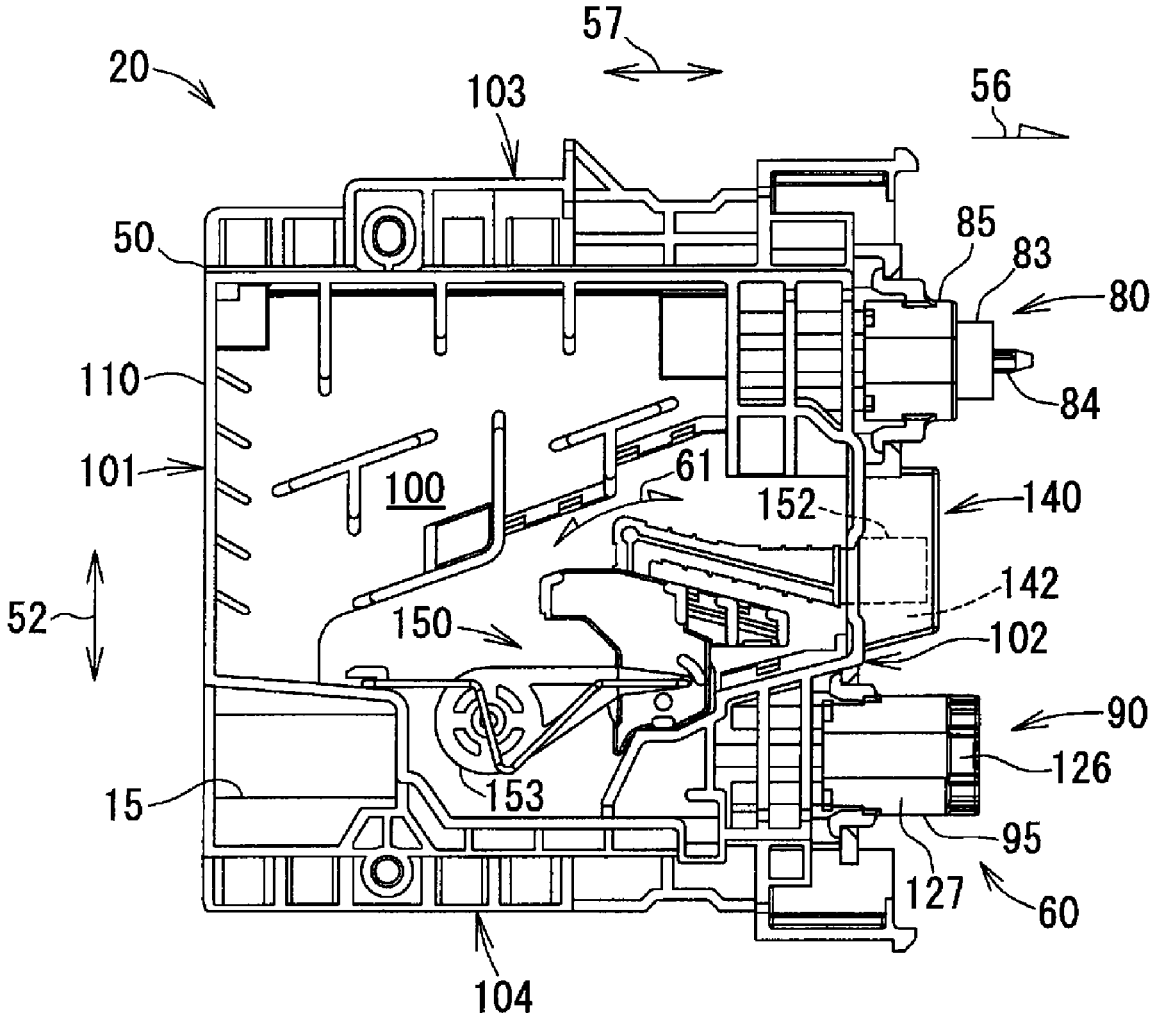
FIG. 4 is a side view a case of the ink cartridge of FIGS. 1(A) and 1(B).
Figure 5:
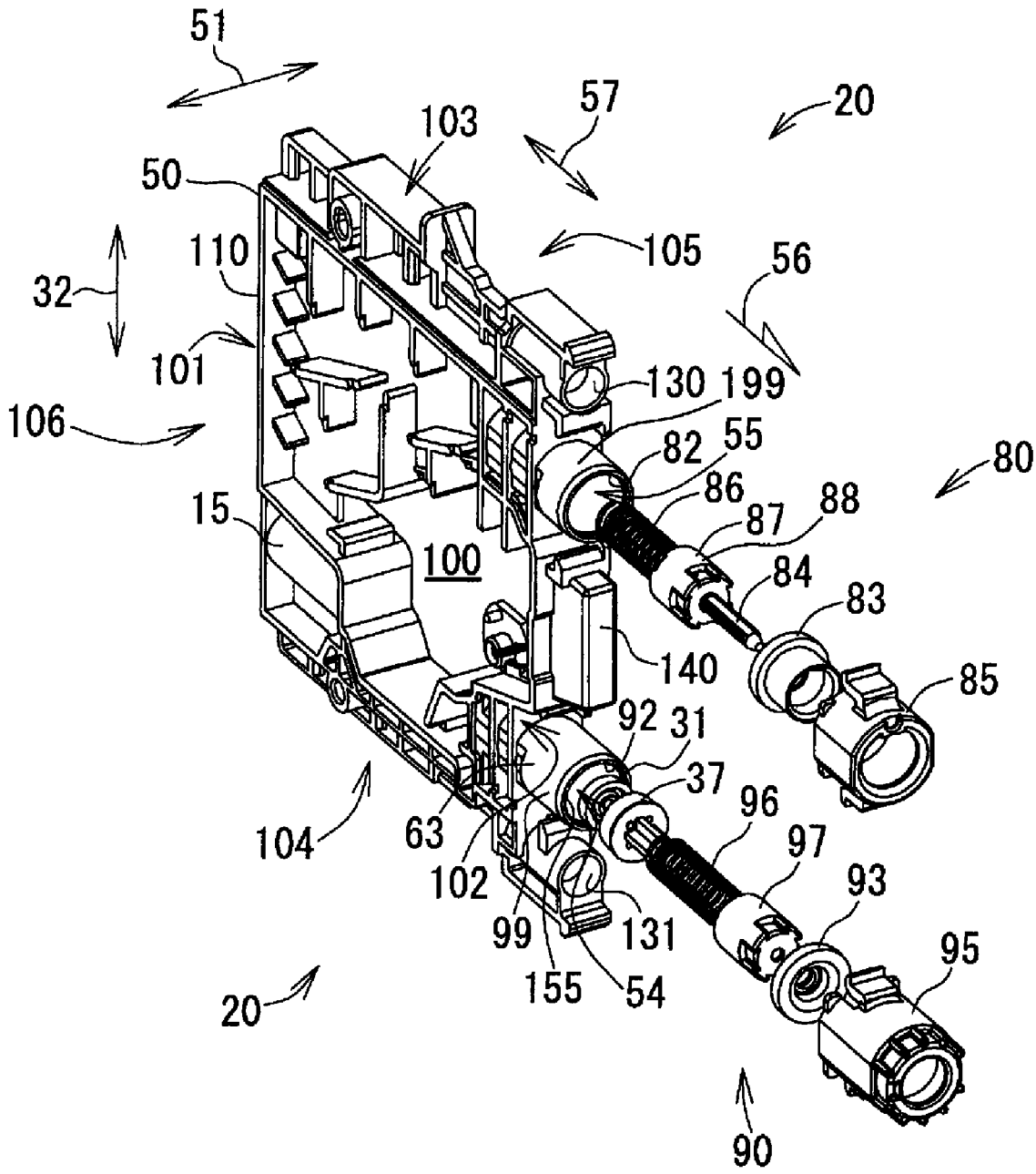
FIG. 5 is an exploded, perspective view of the case of FIG. 4, in which a pivotable member is omitted.

Referring to FIGS. 4 and 5, case 20 may comprise a front face 102, a rear face 101 positioned opposite front wall 102, a top face 103 extending between front face 102 and rear face 101, a bottom face 104 extending between front face 102 and rear face 101 and positioned opposite top face 103, a left face 105 extending between front face 102 and rear face 101, and a right face 106 extending between front face 102 and rear face 101 and positioned opposite left face 105. Each of front face 102, rear face 101, top face 103, bottom face 104, left face 105, and right face 106 may face the exterior of case 20, and define the outer appearance of case 20. When ink cartridge 10 is inserted into mounting portion 202, case 20 may be inserted from a front face 102 side. When the ink cartridge 10 is mounted to mounting portion 202 and is used in the image recording apparatus, top face 103 is positioned at the top of case 20 and bottom face 104 is positioned at the bottom of case 20. Each of an area of left face 105 and an area of right face 106 may be greater than each of an area of front face 102, an area of rear face 101, an area of top face 103, and an area of bottom face 104.

Ink cartridge 10 also may comprise an air communication valve mechanism 80, an ink supply valve mechanism 90, and a pivotable member 150.

Case 20 may comprise a frame 110 and a pair of films (not shown). Frame 110 may comprise front face 102, rear face 101, top face 103, and bottom face 104. The pair of films may comprise left face 105 and right face 106.

Frame 110 may comprise a translucent resin material, e.g., a transparent or semi-transparent resin material, such as polyacetal, nylon, polyethylene, polypropylene, or the like, and may be manufactured by injection molding the resin material.

Frame 110 may have substantially a rectangular profile extending along front face 102, top face 103, rear face 101, and bottom face 104, forming a space inside. As a result, a pair of openings may be formed at widthwise ends of the frame 110, respectively.

The pair of films may be attached, e.g., welded or bonded with adhesive, to the widthwise ends of frame 110, respectively, such that the openings are covered by the pair of films, respectively. Frame 110 and the pair of films may define an ink chamber 100 therein. Ink chamber 100 may be configured to store ink therein. In another embodiment, a frame may be a container having six rigid walls, and an ink chamber may be formed in the container.

Referring to FIGS. 4 and 5, frame 110 may comprise an ink filling portion 15 positioned at rear face 101. Ink filling portion 15 may comprise substantially a circular, cylindrical chamber extending from rear surface 101 toward ink chamber 100. The cylindrical chamber of ink filling portion 15 may be configured to be in fluid communication with ink chamber 100. When ink cartridge 10 is manufactured, ink may be introduced into ink chamber 100 via ink filling portion 15, such that ink chamber 100 is filled with ink.

Case 20 may comprise a detection portion 140 extending from front face 102 away from ink chamber 100. The amount of ink stored in ink chamber 100 may be visually or optically detected via detection portion 140. Detection portion 140 may be integral with frame 110. Therefore, detection portion 140 may comprise the same material as frame 110, i.e., a translucent resin material, e.g., a transparent or semi-transparent resin material. Light may pass through detection portion 140. When ink cartridge 10 is mounted to mounting portion 202, detection portion 140 may be irradiated with light emitted from an optical sensor, i.e., a photo-interrupter, positioned in mounting portion 202. Detection portion 140 may have an inner space 142 formed therein. Inner space 142 may be continuous with ink chamber 100.

Pivotable member 150 may be positioned in ink chamber 100. Pivotable member 150 may comprise an indicator portion 152 at a first end of pivotable member 150. Indicator portion 152 may be positioned in inner space 142 and may be configured to move in inner space 142. Pivotable member 150 may comprise a float portion 153 at a second end of pivotable member 150. Pivotable member 150 may be pivotably supported by case 20 at a position between indicator portion 152 and float portion 153, such that pivotable member 150 pivots in directions indicated by an arrow 61 in FIG. 4. The specific gravity of float portion 153 may be less than the specific gravity of ink stored in ink chamber 100. For example, float portion 153 may comprise a hollow formed therein, such that the specific gravity of float portion 153 is less than the specific gravity of ink stored in ink chamber 100. Therefore, float portion 153 may be configured to float on ink and move up and down according to an increase or a decrease in the amount of ink in ink chamber 100. Pivotable member 150 may pivot in accordance with the movement of float portion 153, and indicator portion 152 may move in inner space 142 in accordance with the pivotal movement of pivotable member 150. The position of indicator portion 152 in inner space 142 may be detected by the optical sensor, or may be detected visually, from the exterior of detection portion 140. The position of indicator portion 152 may indicate whether the amount of ink in ink chamber 100 is greater than or equal to a predetermined amount of ink.

Referring to FIGS. 1(A)-2(B), first cover 21 may have a container shape and may accommodate a front portion of case 20 with respect to insertion direction 56, i.e., first cover 21 may accommodate front face 102 side of case 20. Second cover 22 may have a container shape and may accommodate a rear portion of case 20 with respect to insertion direction 56, i.e., second cover 22 may accommodate rear face 101 side of case 20. Accordingly, the front portion of case 20 may be protected by first cover 21, and the rear portion of case 20 may be protected by second cover 22.

First cover 21 may comprise a front wall 161 facing front face 102 of case 20, and an opening 19 may be formed through front wall 161. First cover 21 may be configured to slide in depth direction 57 with respect to second cover 22. In FIGS. 1(A) and 2(A), first cover 21 is in a second position in which front wall 161 is positioned closest to front face 102 of case 20 within the sliding range of first cover 21. In FIGS. 1(B) and 2(B), first cover 21 is in a first position in which front wall 161 is positioned furthest from front face 102 of case 20 within the sliding range of first cover 21.

Referring to FIGS. 2(A) and 2(B), first cover 21 may comprise supporting bars 168 and 169 positioned at a surface of the front wall 161, facing front face 102 of case 20. Case 20 may comprise spring chambers 130 and 131 formed in front face 102. Spring chambers 130 and 131 may be positioned adjacent to top face 103 and bottom face 104, respectively. Coil springs 23 and 24 may be accommodated in spring chambers 130 and 131, respectively, and supporting bars 168 and 169 may be inserted into coil springs 23 and 24, respectively. Coil springs 23 and 24 may be accommodated in spring chamber 130 and 131 while being compressed. Therefore, coil springs 23 and 24 may apply a biasing force to first cover 21 toward the first position. Accordingly, when no external force is applied to first cover 21, coil springs 23 and 24 may bias first cover 21 into the first position. When an external force is applied to first cover 21 against the biasing force of coil springs 23 and 24, first cover 21 may move from the first position to the second position.

Figure 6:
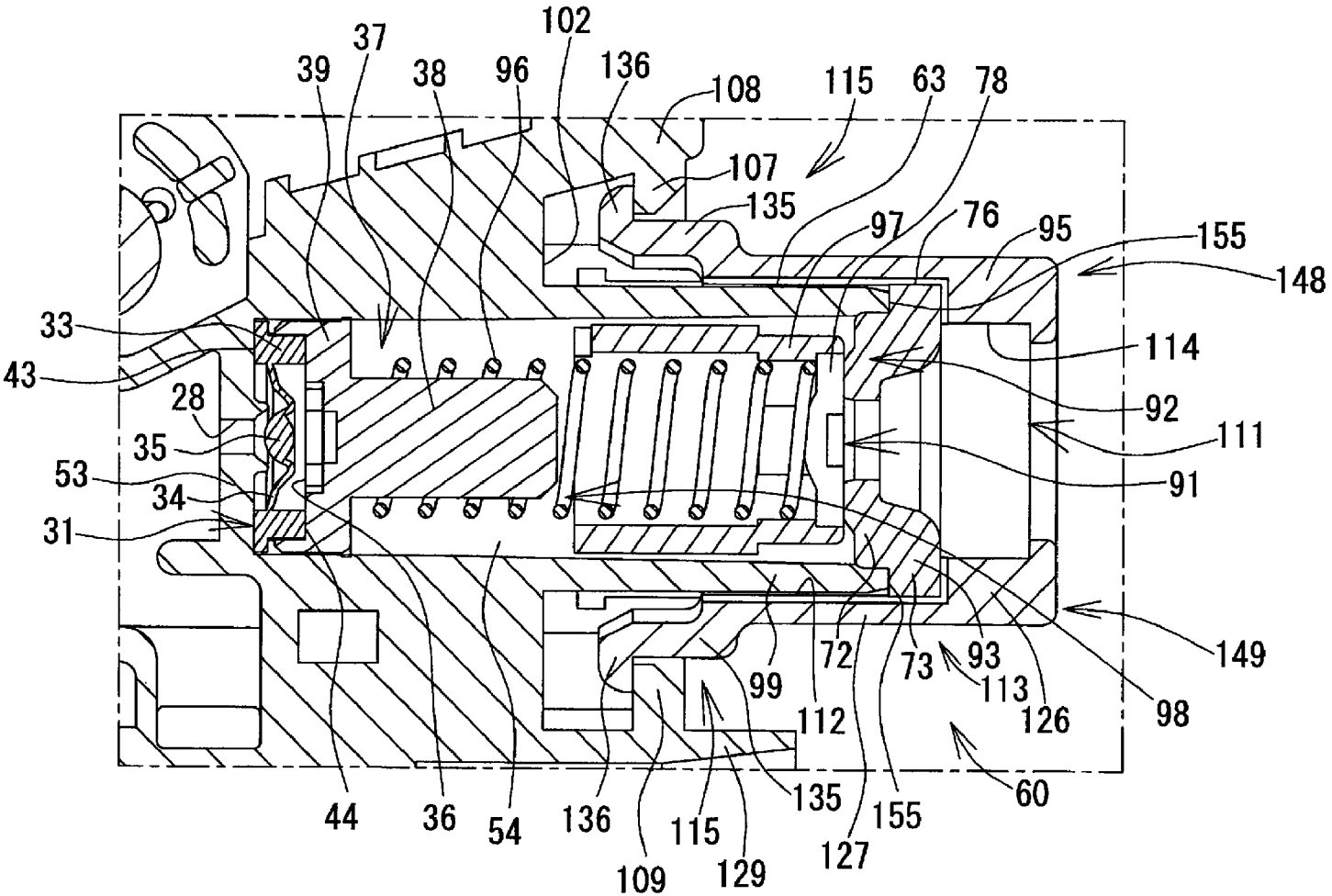
FIG. 6 is a partial, cross-sectional view of the case of FIG. 4, showing a structure adjacent to an ink supply portion, in which an ink supply opening is covered.

Referring to FIG. 5, an opening 98 may be formed through front face 102 of case 20. Opening 98 may be positioned closer to bottom face 104 than to top face 103. Referring to FIGS. 4-6, ink cartridge 10 may comprise an ink supply portion 60 positioned at front face 102 of case 20. Ink supply portion 60 may comprise an ink supply wall 99 and ink supply valve mechanism 90. Ink supply wall 99 may extend from a particular portion of front face 102 toward the exterior of case 20 in depth direction 57, and the particular portion may surround opening 98. Ink supply wall 99 may have a tube shape, e.g., a circular, cylindrical tube shape. In another embodiment, ink supply wall 99 may have a rectangular, cylindrical tube shape. Referring to FIG. 6, a valve chamber 54 may be formed in ink supply wall 99, and valve chamber 54 may extend from the interior of ink supply wall 99 to the interior of case 20 beyond front face 102 via opening 98. Valve chamber 54 may extend in depth direction 57. In an embodiment, valve chamber 54 may have a circular, cylindrical shape. Case 20 may comprise an end wall 53 defining the inner most end of valve chamber 54, and an opening 28 may be formed through end wall 53. Valve chamber 54 is configured to be in fluid communication with ink chamber 100 via opening 28. At least a portion of ink supply valve mechanism 90 may be accommodated in valve chamber 54.

Referring to FIGS. 5 and 6, an opening 92 may be formed at an end 155 of ink supply wall 99 opposite opening 98. Ink supply valve mechanism 90 may be configured to selectively allow and prevent fluid communication between the interior of ink chamber 100 and the exterior of case 20 via opening 92 and valve chamber 54. Ink supply valve mechanism 90 may comprise a first valve element 31, a valve seat 37, a coil spring 96, a second valve element 97, a sealing member 93, and a cap 95. Each of first valve element 31, valve seat 37, coil spring 96, second valve element 97, sealing member 93, and cap 95 may comprise a resin, such as polyacetal or silicon rubber.

First valve element 31, valve seat 37, coil spring 96, second valve element 97, sealing member 93, and cap 95 may be sequentially aligned in depth direction 57 and may contact each other. First valve element 31, valve seat 37, coil spring 96, and second valve element 97 may be accommodated in valve chamber 54. Sealing member 93 and cap 95 may be positioned at end 155 of ink supply wall 99.

Figure 7:
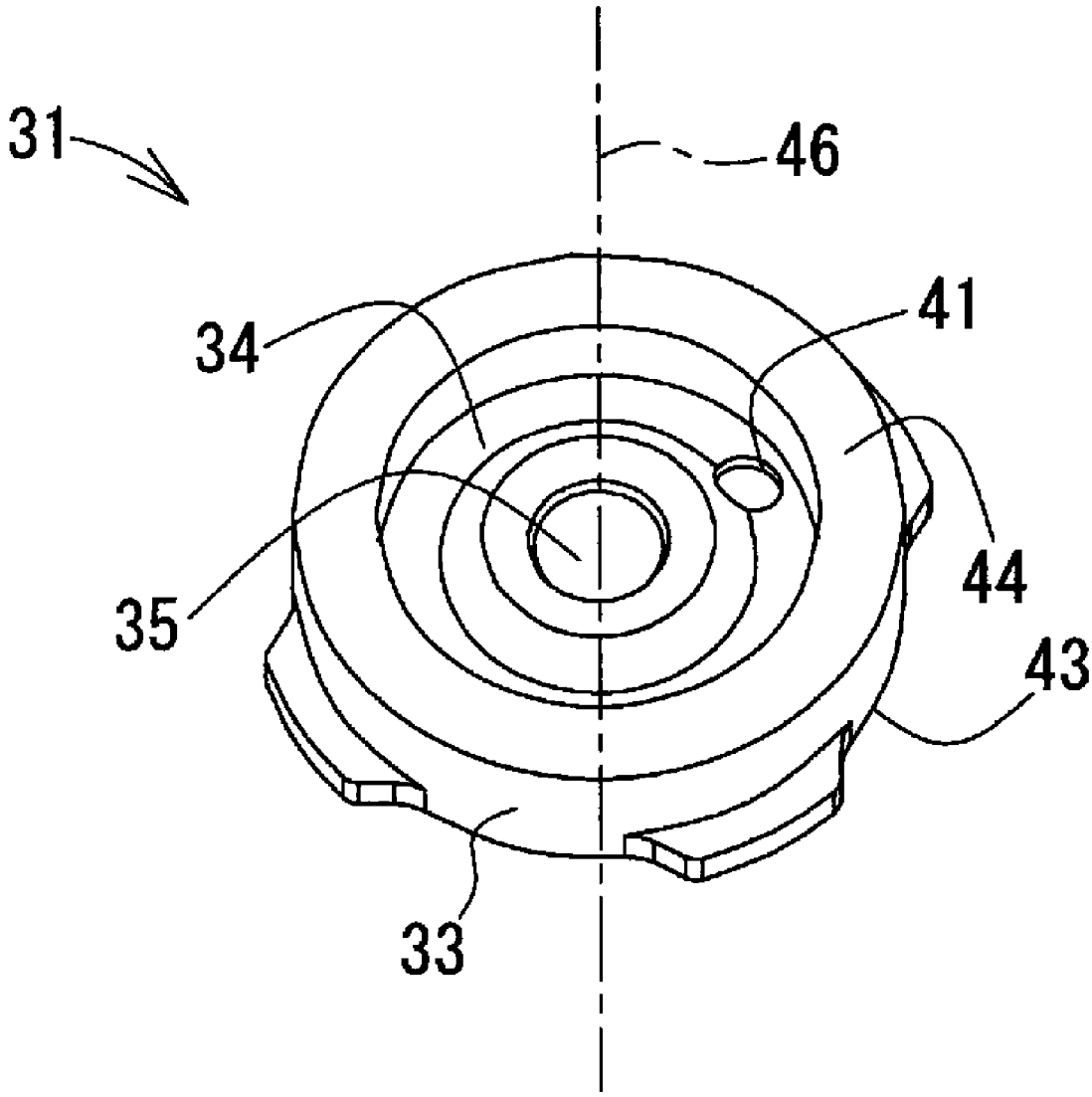
FIG. 7 is a perspective view of a first valve element.
Figure 8:
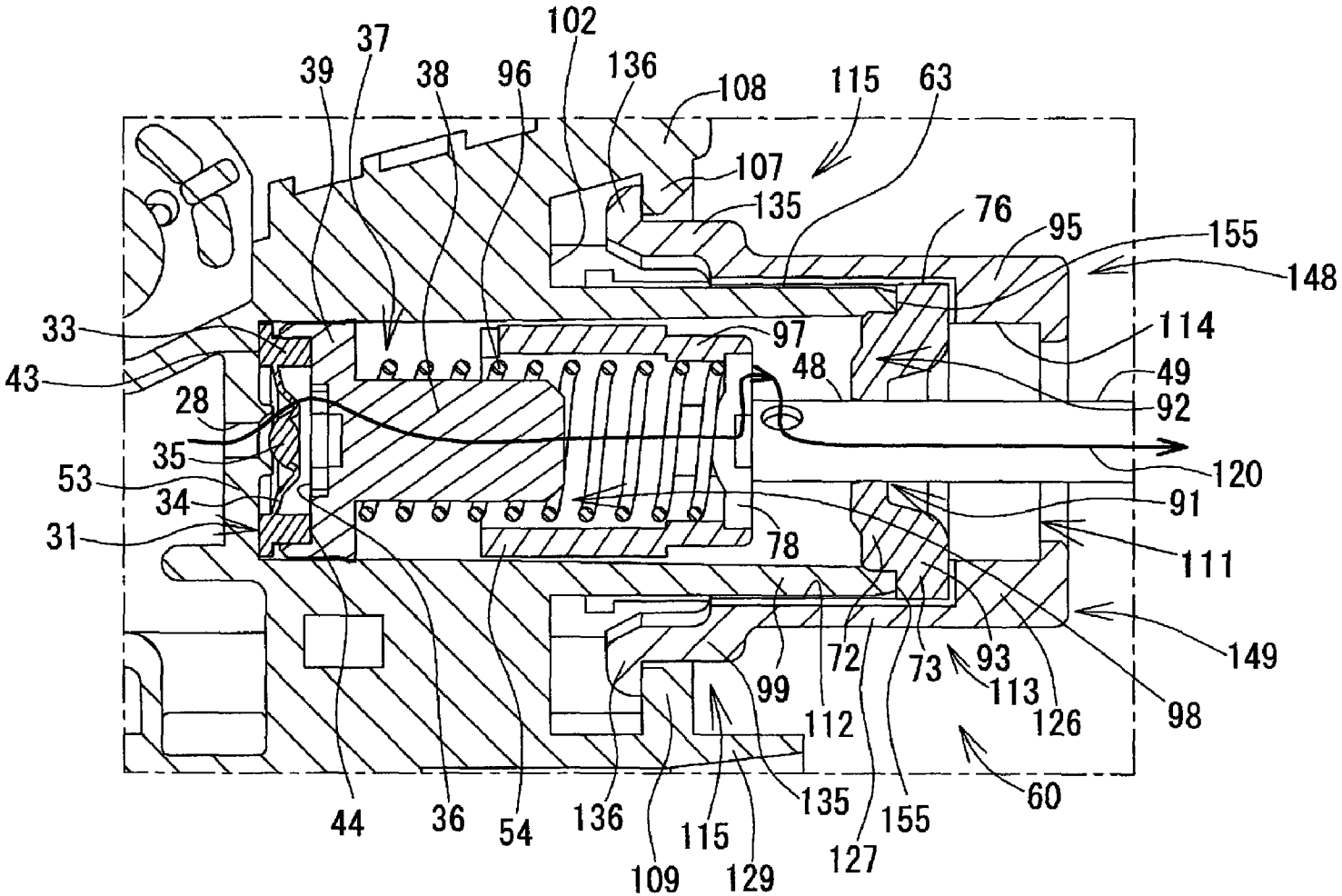
FIG. 8 is a partial, cross-sectional view of the case of FIG. 4, showing a structure adjacent to the ink supply portion, in which the ink supply opening is uncovered.

Referring to FIG. 7, first valve element 31 may comprise a first side 43 and a second side 44 opposite first side 43. Referring to FIG. 6, first valve element 31 may be positioned in valve chamber 54, such that first side 43 contacts end wall 53 and second side 44 contacts valve seat 37. First valve element 31 may be configured to selectively cover and uncover opening 28 formed through end wall 53. First valve element 31 may be manufactured by injection-molding silicon rubber.

Referring to FIG. 7, first valve element 31 may comprise a circular, cylindrical member 33, an inner wall 34, and a lid member 35. Referring to FIG. 6, circular, cylindrical member 33 may receive a biasing force from coil spring 96 via valve seat 37. The biasing force brings circular, cylindrical member 33 into tight contact with end wall 53. Referring to FIG. 7, inner wall 34 may extend in a direction intersecting a center line 46 of circular, cylindrical member 33 inside circular cylindrical member 33. Center line 46 may be parallel to depth direction 57. Referring to FIG. 6, inner wall 34 may be bent in a cross-sectional view. In an embodiment, inner wall 34 may be a thin wall comprising silicon rubber, such that inner wall 34 has flexibility. Therefore, inner wall 34 readily may be deformed when inner wall 34 receives pressure from ink. Referring to FIG. 7, an opening 41 may be formed through inner wall 34 in a direction parallel to center line 46. Ink may pass through opening 41 when ink flows from ink chamber 100 into valve chamber 54. Lid member 35 may be positioned at the center of inner wall 34. Lid member 35 may selectively cover and uncover opening 28 of end wall 53. In an embodiment, lid member 35 may have a spherical shape.

Referring to FIG. 6, valve seat 37 may be manufactured by injection-molding polypropylene resin. Valve seat 37 may comprise a valve seat base portion 38 and a valve element receiving portion 39. Valve seat base portion 38 may have a circular, cylindrical rod shape extending from the center of a circular surface of valve element receiving portion 39 in depth direction 57. The outer diameter of the valve seat base portion 38 may be slightly smaller than the inner diameter of the coil spring 96. Valve seat base portion 38 may be inserted into coil spring 96. Accordingly, coil spring 96 may be supported by the valve seat base portion 38, such that coil spring 96 is configured to expand and to contract in the direction in which valve seat base portion 38 extends, i.e., in depth direction 57. An end of coil spring 96 may contact the circular surface of valve element receiving portion 39.

Valve element receiving portion 39 may receive and contact first valve element 31. Valve element receiving portion 39 may have a circular, cylindrical shape. The outer diameter of valve element receiving portion 39 may be slightly less than the diameter of valve chamber 54. Valve element receiving portion 39 may have a circular, cylindrical recess 36 formed therein. First valve element 31 may be positioned in recess 36. The diameter of recess 36 may be slightly greater than the outer diameter of circular, cylindrical member 33 of first valve element 31. The depth of recess 36 may be substantially equal to the thickness of circular, cylindrical member 33 in a direction parallel to center line 46, i.e., in depth direction 57. An opening may be formed through a bottom surface of recess 36, such that ink may pass therethrough. Valve seat 37 may press circular, cylindrical member 33 of first valve element 31 toward end wall 53 upon receiving the biasing force of coil spring 96.

When ink in valve chamber 54 flows toward ink chamber 100, the ink may apply a force to inner wall 34 of first valve element 31, such that inner wall 34 deforms to move lid member 35 toward opening 28. When lid member 35 contacts end wall 53 and covers opening 28, ink may be prevented from flowing from valve chamber 54 to ink chamber 100. When ink in ink chamber 100 flows into valve chamber 54, the ink may flow through opening 28 and apply a force to inner wall 34, such that inner wall 34 deforms to move lid member 35 away from end wall 53. Accordingly, opening 28 may be uncovered. As such, ink may flow from ink chamber 100 via opening 28, opening 41, and the opening formed through the bottom surface of recess 36 into valve chamber 54.

Referring to FIG. 6, second valve element 97 may be configured to move in depth direction 57. Second valve element 97 may comprise a wall 78 configured to contact seal member 93. Coil spring 96 may be positioned between valve element receiving portion 39 of valve seat 37 and wall 78 of second valve element 97 while being compressed. Coil spring 96 may bias valve element receiving portion 39, such that circular, cylindrical member 33 of first valve element 31 contacts end wall 53 tightly. Coil spring 96 may bias second valve element 97 toward sealing member 93, such that wall 78 of second valve element 97 contacts sealing member 93.

Sealing member 93 may comprise an elastic material, such as rubber, such that sealing member 93 is configured to elastically deform. Sealing member 93 may comprise a first circular, cylindrical portion 72 positioned in valve chamber 54 via opening 92, and a second circular cylindrical portion 73 which is in contact with end 155 of ink supply wall 99 defining opening 92. The outer diameter of first circular, cylindrical portion 72 may be substantially equal to the diameter of valve chamber 54. The outer diameter of second circular, cylindrical portion 73 may be greater than the diameter of valve chamber 54, and may be substantially equal to the inner diameter of an inner surface 112 of cap 95. Cap 95 may be attached to case 20, such that cap 95 presses sealing member 93 against end 155 of ink supply wall 99 defining opening 92. Accordingly, sealing member 93 may elastically deform and contact end 155 of ink supply wall 99 liquid tightly. Moreover, because second circular, cylindrical portion 73 is pressed between cap 95 and end 155 of ink supply wall 99, second circular, cylindrical portion 73 may elastically expand, such that the diameter thereof increases. Accordingly, an outer surface 76 of second circular, cylindrical portion 73 may contact inner surface 112 of cap 95 liquid tightly.

An ink supply opening 91 may be formed through the center of first circular, cylindrical portion 72 and the center of second circular cylindrical portion 73. Opening 91 may have substantially a circular conical shape. Coil spring 96 may bias second valve element 97 toward sealing member 93, such that wall 78 of second valve element 97 contacts sealing member 93 and covers opening 91. Therefore, fluid communication between the interior of ink chamber 100 and the exterior of case 20 via opening 91 and valve chamber 54 may be prevented. When an external force is applied to second valve element 97 against the biasing force of coil spring 96, second valve element 97 may move away from sealing member 93, and opening 91 may be uncovered. Consequently, fluid communication between the interior of ink chamber 100 and the exterior of case 20 via opening 91 and valve chamber 54 may be allowed.

Referring to FIGS. 8-11, cap 95 may comprise a cap body 113 and engaging members 115. Cap body 113 may comprise an end wall 125, a first peripheral wall 126, and a second peripheral wall 127. End wall 125 may have a disk shape, and may define an end 133 of cap 95. An opening 111 may be formed through end wall 125. Valve chamber 54, ink supply opening 91, and opening 111 may be aligned in depth direction 57.

First peripheral wall 126 may extend from a peripheral edge of end wall 125. First peripheral wall 126 may comprise an outer surface 166 having a circular, cylindrical shape, and an inner surface 114 having a circular, cylindrical shape. The outer diameter of first peripheral wall 126 may be less than the outer diameter of second peripheral wall 127. The inner diameter of first peripheral wall 126 may be slightly less than the diameter of valve chamber 54. The thickness of the first peripheral wall 126 may be greater than the thickness of second peripheral wall 127 in the radial direction of cap body 113, which may be perpendicular to depth direction 57.

Second peripheral wall 127 may comprise an outer surface 167 having substantially a circular, cylindrical shape, and inner surface 112 having a circular, cylindrical shape. The inner diameter of second peripheral wall 127 may be substantially equal to the outer diameter of ink supply wall 99 and the outer diameter of second circular, cylindrical portion 73 of sealing member 93. An outer surface 63 of ink supply wall 99 and outer surface 76 of second circular, cylindrical portion 73 of sealing member 93 may be covered by second peripheral wall 127. Sealing member 93 may be pressed by cap 95, and may elastically deform, such that the diameter of sealing member 93 increases. Accordingly, outer surface 76 of second circular, cylindrical portion 73 of sealing member 93 may contact inner surface 112 of second peripheral wall 127 tightly.

First peripheral wall 126 and second peripheral wall 127 may each have a central axis. The central axis of first peripheral wall 126 and the central axis of second peripheral wall 127 may be the same central axis. Therefore, cap body 113 may have a central axis 159 extending in depth direction 57, i.e., first peripheral wall 126 and second peripheral wall 127 may have common central axis 159. Because the outer diameter of first peripheral wall 126 may be less than the outer diameter of second peripheral wall 127, outer surface 166 of first peripheral wall 126 may be positioned closer to central axis 159 than outer surface 167 of second peripheral wall 127 is positioned to central axis 159. Cap body 113 may comprise a wall 132 extending between first peripheral wall 126 and second peripheral wall 127. Cap 95 may have an end 138 opposite end 133. First peripheral wall 126 may have a first end connected to end wall 125 and a second end opposite the first end of first peripheral wall 126. The second end of first peripheral wall 126 may be positioned closer to end 138 of cap 95 than the first end of first peripheral wall 126 is positioned to end 138 of cap 95. Wall 132 may extend from the second end of first peripheral wall 126 in a plurality of different radial directions of cap body 113, and each of the plurality of radical directions may be perpendicular to an axial direction of cap body 113 in which central axis 159 extends. Wall 132 also may extend in a circumferential direction 157 of cap body 113 around central axis 159.

Figure 9:
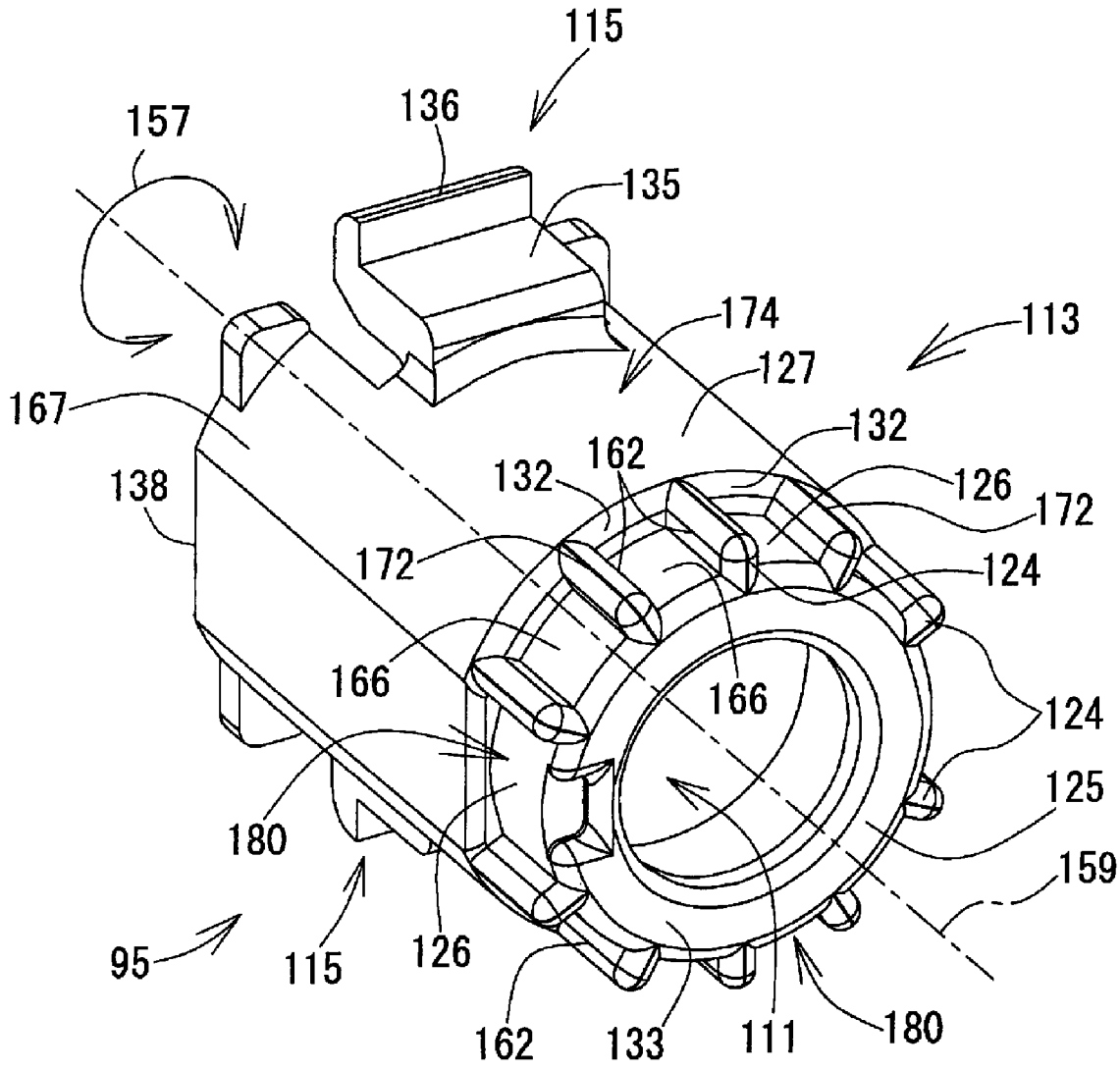
FIG. 9 is a perspective view of a cap.
Figure 10:
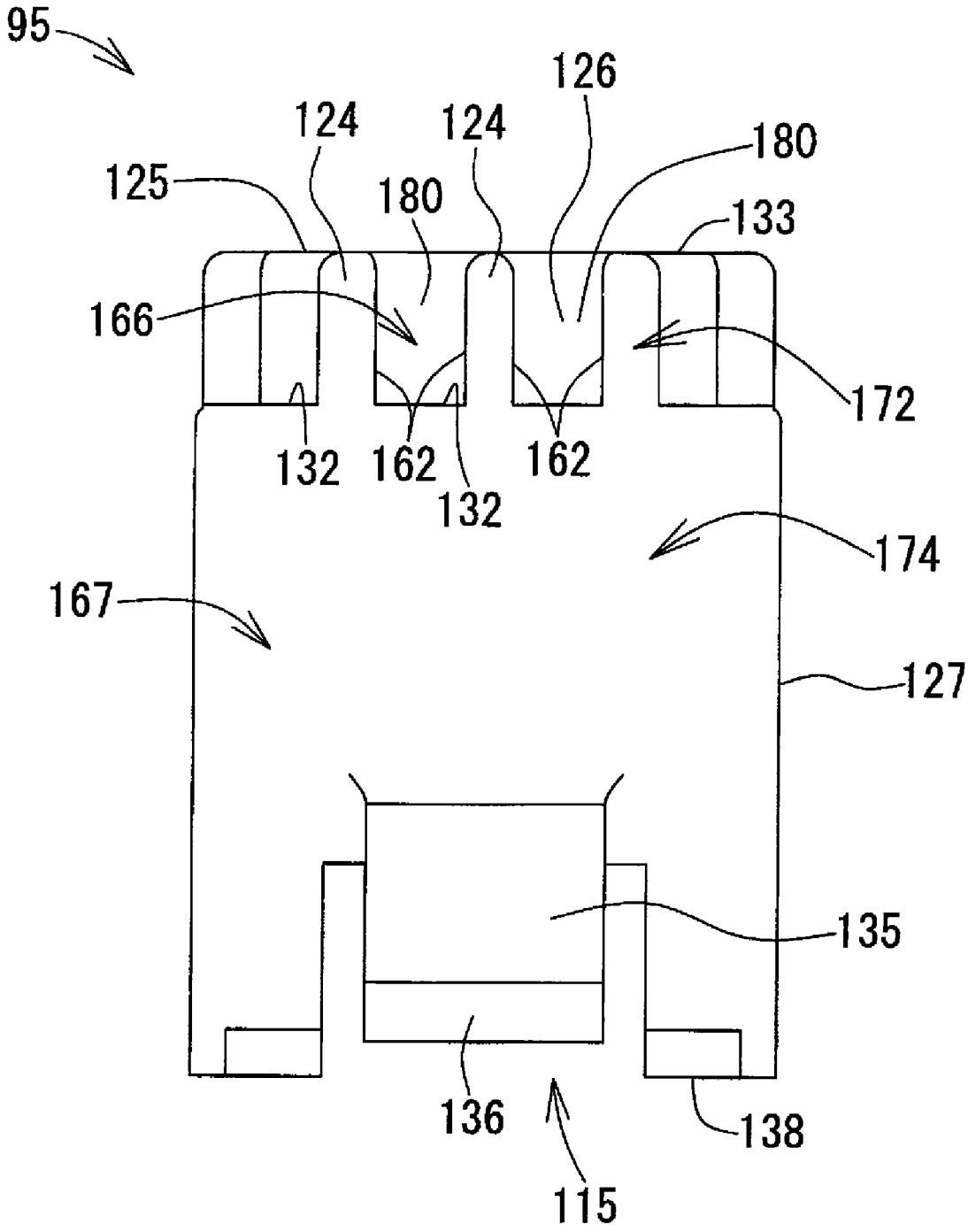
FIG. 10 is a side view of the cap of FIG. 9.
Figure 11:
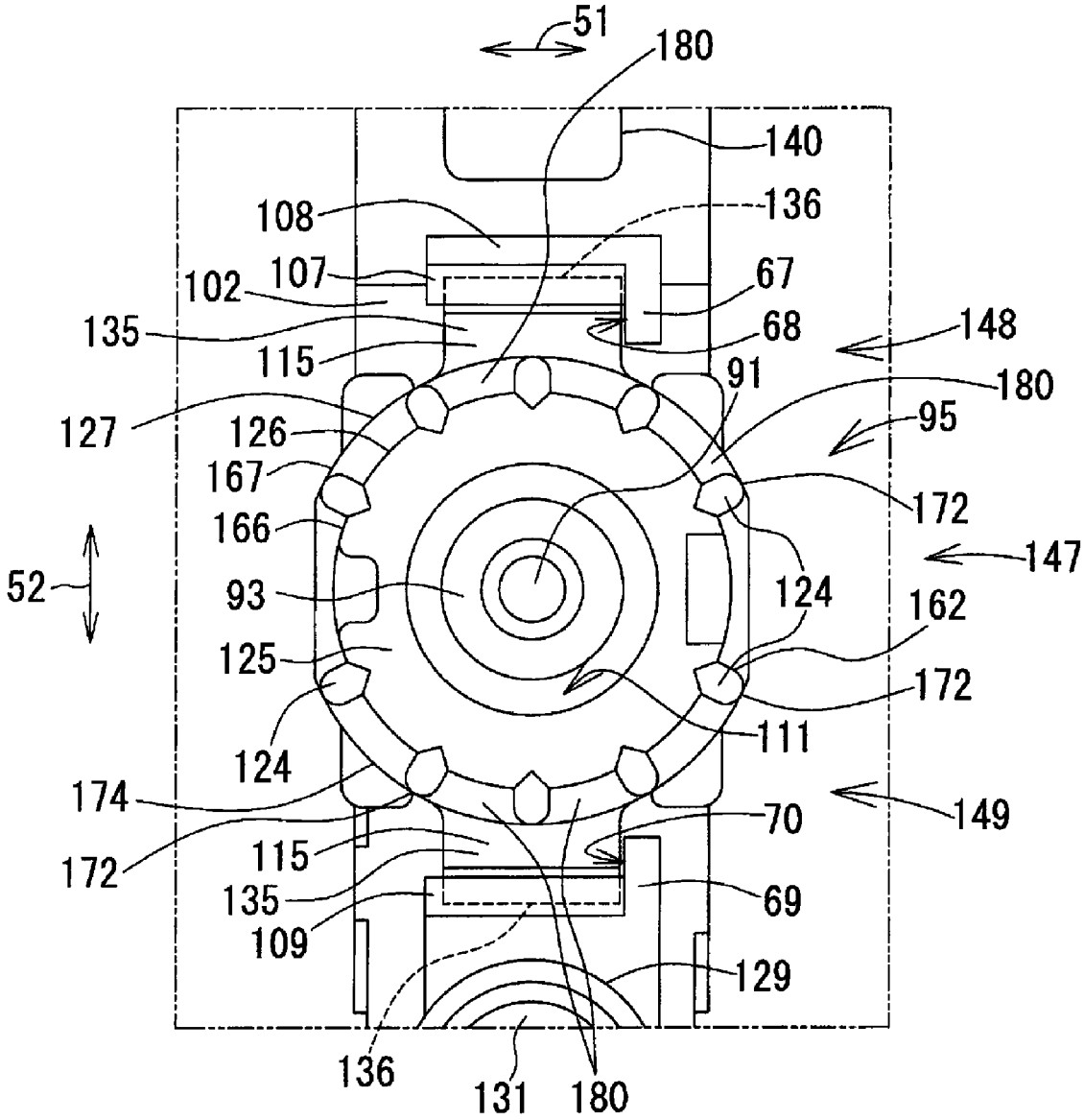
FIG. 11 is a partial, front view of the case of FIG. 4, showing a structure adjacent to the cap of FIG. 9.

Referring to FIGS. 9-11, engaging members 115 may extend from outer surface 167 of second peripheral wall 127. In this embodiment, two engaging members 115 may be positioned on outer surface 167 of second peripheral wall 127, such that central axis 159 of second peripheral wall 127 is positioned between the thus engaging members 115. Each engaging member 115 may comprise an elastically deforming portion 135 and a hook portion 136. Elastically deforming portion 135 may have substantially an L-shape which first extends outward from outer surface 167 of second peripheral wall 127 in the radial direction of second peripheral wall 127, which is perpendicular to depth direction 57, and then extends toward end 138 of the cap 95 in the axial direction of second peripheral wall 127, which is parallel to depth direction 57 and is parallel to central axis 159 of second peripheral wall 127. Hook portion 136 may extend outward in the radial direction of second peripheral wall 127 from an end of elastically deforming portion 135. Elastically deforming portion 135 may be configured to elastically deform to bend with respect to outer surface 167 of second peripheral wall 127, such that hook portion 136 moves outward and inward in the radial direction of second peripheral wall 127.

Referring to FIGS. 6 and 11, case 20 may comprise engaging portions 107 and 109 at front face 102 at positions corresponding to hook portions 136 of cap 95, respectively. Hook portions 136 may engage engaging portions 107 and 109, respectively. Engaging portion 107 may extend toward bottom face 104 and toward outer surface 63 of ink supply wall 99 from a wall 108 extending from front face 102. Engaging portion 109 may extend toward top face 102 and toward outer surface 63 of ink supply wall 99 from a wall 129 extending from front face 102.

Referring to FIG. 11, case 20 may comprise guide members 67 and 69 positioned adjacent to engaging portions 107 and 109, respectively. Guide members 67 and 69 may be configured to guide engaging members 115 toward the engaging portions 107 and 109, respectively, when cap 95 is attached to case 20 during the manufacture of ink cartridge 10. Guide members 67 and 69 may be positioned further outward from front face 102 than engaging portions 107 and 109 are positioned from front face 102. Guide members 67 and 69 may comprise guide surfaces 68 and 70 configured to contact elastically deforming portions 135 and hook portions 136.

Referring to FIGS. 6 and 11, when ink cartridge 10 is manufactured, cap 95 may be attached to case 20 from an end 138 side. Hook portions 136 may be brought into contact with guide surfaces 68 and 70. Subsequently, when cap 95 is pressed toward front face 102, hook portions 136 may be pressed against engaging portions 107 and 109. When this occurs, elastically deforming portions 135 may elastically deform toward outer surface 63 of ink supply wall 99, and hook portions 136 may move over engaging portions 107 and 109. When cap 95 is further pressed toward front face 102, hook portions 136 may return to their original positions by the elasticity of the elastically deforming portions 135, such that hook portions 136 and engaging portions 107 and 109 are engaged. Accordingly, referring to FIG. 6, cap 95 is attached to case 20, such that ink supply wall 99 is positioned between engaging members 115 in height direction 52. One of engaging members 115 may be positioned in a position between ink supply wall 99 and top face 103, and the other of engaging members 115 may be positioned in a position between ink supply wall 99 and bottom wall 104.

Referring to FIGS. 9-11, cap 95 may comprise a plurality of, e.g., ten, protrusions 124 on outer surface 166 of first peripheral wall 126. Protrusions 124 may be aligned in circumferential direction 157 of first peripheral wall 126 around central axis 159 at a predetermined interval. Protrusion 124 may extend outward from outer surface 166 of the first peripheral wall 126 in a corresponding radial direction of first peripheral wall 126. Moreover each corresponding radial direction may be perpendicular to the axial direction of first peripheral wall 166 in which central axis 159 extends, and may extend in the axial direction of first peripheral wall 126. Protrusions 124 may be connected to wall 132 and second peripheral wall 127. Protrusions 124 may increase the rigidity of end wall 125, first peripheral wall 126, and second peripheral wall 127. Each of protrusions 124 may comprise a pair of side walls 162 intersecting outer surface 166 of first peripheral wall 126 and wall 132. One of pair of side walls 162 of one protrusion 124 may face one of pair of side walls 162 of another adjacent, i.e., neighboring, protrusion 124.

Each of protrusions 124 may comprise a base portion connected to outer surface 166 of first peripheral wall 126 and an end surface 172 opposite the base portion. End surface 172 may be connected to the pair of side walls 162. End surface 172 may extend in the axial direction of first peripheral wall 126 in which central axis 159 extends. In an embodiment, end surface 172 may be flush with outer surface 167 of second peripheral wall 127. Outer surface 167 of second peripheral wall 127 and end surfaces 127 of protrusions 124 may comprise a guide surface 174 configured to guide ink supply portion 60 with respect to mounting portion 202 when ink cartridge 10 is inserted into mounting portion 202. Referring to FIG. 3, mounting portion 202 may comprise a circular, cylindrical connecting portion 208. Connecting portion 208 may be configured to receive and hold ink supply portion 60 therein. Connecting portion 208 may have an inner surface 205 formed therein, and inner surface 205 may contact guide surface 174 when connecting portion 208 receives and holds ink supply portion 60. Inner surface 205 may have substantially a circular, cylindrical shape. The inner diameter of connecting portion 208 may be slightly greater than the outer diameter of second peripheral wall of cap 95. Ink tube 49 may be positioned at the center of the connecting portion 208. Ink tube 49 may extend from an end of connecting portion 208 to the exterior of connecting portion 208. Flexible tube 207 may be connected to ink tube 49. When ink cartridge 10 is inserted into mounting portion 202, an inclined surface 203 may guide cap 95 toward the center of connecting portion 208. Guide surface 174 of cap 95 may be guided by inclined surface 203, such that opening 111 is aligned with ink tube 49. When the ink cartridge 10 is further inserted, guide surface 174 may slide on inner surface 205 of connecting portion 208. Accordingly, ink supply portion 60 may be positioned in connecting portion 208, and ink tube 49 may be inserted into ink supply opening 91 through opening 111.

Referring to FIGS. 9-11, an ink holding space 180 may be formed on outer surface 166 of first peripheral wall 126. Ink holding space 180 may be configured to hold ink adhering to end 133 of cap 95 or outer surface 166 of first side wall 126. In an embodiment, ink holding space 180 may be defined by outer surface 166, pair of side walls 162 of adjacent, e.g., neighboring, two protrusions 124, and wall 132. Ink holding space 180 may have a first end and a second end opposite the first end of ink holding space 180. The first end of ink holding space 180 may be positioned closer to end wall 125 than the second end of ink holding space 180 is positioned to end wall 125. There may be no wall between end 133 of cap 95 and ink holding space 180, e.g., ink holding space 180 may be open at the first end of the ink holding portion. Wall 132 may define the second end of ink holding space 180, e.g., wall 132 may terminate ink holding space 180 at the second end of ink holding space 180. A size of ink holding space 180 may be selected, such that ink adhering to outer surface 66 is held in ink holding space by capillary force. The interval between adjacent protrusions 124, the height of protrusions 124 in the radial directions of second peripheral wall 127, and the length of protrusions 124 in the axial direction of second peripheral wall 127 may be selected according to at least one characteristic of ink stored in ink chamber 100.

In an embodiment, because wall 132 extends in circumferential direction 157 of first peripheral wall 126, and protrusions 124, e.g., ten protrusions, are aligned in circumferential direction 157 of first peripheral wall 126, ink holding spaces 180, e.g., ten ink holding spaces, may be aligned in circumferential direction 157 along outer surface 166. Therefore, ink holding spaces 180 may be formed at an upper portion 148, an intermediate portion 147, and a lower portion 149 of ink supply portion 60. Upper portion 148 may be positioned between valve chamber 54 and a plane on which top face 103 lies, lower portion 149 may be position between valve chamber 54 and a plane on which bottom face 104 lies, and intermediate portion 147 may be positioned between upper portion 148 and lower portion 149. Therefore, when ink cartridge 10 is mounted to mounting portion 202, ink holding spaces 180 formed at upper portion 148 may be positioned above ink supply wall 99, and ink holding spaces 180 formed at lower portion 149 may be positioned below ink supply wall 99. In another embodiment, protrusions 124 may be formed only at lower portion 149 of ink supply portion 60.

Referring to FIGS. 1(A)-2(B), when first cover 21 is in the first position, cap 95 may be positioned in the interior of first cover 21, as shown in FIGS. 1(B) and 2(B). When first cover 21 moves from the first position to the second position, cap 95 may pass through opening 19, and when first cover 21 is in the second position, cap 95 may be positioned outside first cover 21, as shown in FIGS. 1(A) and 2(A). The diameter of opening 19 may be slightly greater than the outer diameter of second peripheral wall 127 of cap 95.

Referring to FIG. 5 case 20 may comprise air communication wall 199 extending toward the exterior of case 20 in depth direction 57 from a predetermined portion of front face 102 and the predetermined portion may be positioned closer to top face 103 than to bottom face 104. Air communication wall 199 may have a tube shape, e.g., a circular, cylindrical tube shape. Valve chamber 55 may be formed in air communication wall 199, and valve chamber 55 may extend from the interior of air communication wall 199 to the interior of case 20 beyond front face 102. Valve chamber 55 may extend in depth direction 57. In an embodiment, valve chamber 55 may have a circular, cylindrical shape. Valve chamber 55 may be configured to be in fluid communication with ink chamber 100. At least a portion of air communication valve mechanism 80 may be positioned in valve chamber 55.

An opening 82 may be formed at and in an end of air communication wall 199. Air communication valve mechanism 80 may be configured to selectively allow and prevent fluid communication between the interior of ink chamber 100 and the exterior of case 20 via opening 82 and valve chamber 55. Air communication valve mechanism 80 may comprise a coil spring 86, a valve element 87, a sealing member 83, and a cap 85. Each of coil spring 86, valve element 87, sealing member 83, and cap 85 may comprise a resin such as polyacetal or silicon rubber.

Coil spring 86, valve element 87, sealing member 83, and cap 85 may be sequentially aligned in depth direction 53 and may contact each other. Coil spring 86 and valve element 87 may be positioned in valve chamber 55. Sealing member 83 and cap 85 may be positioned at a portion of air communication wall 199 defining opening 82.

Valve element 87 may be configured to move in depth direction 57. Valve body 87 may comprise a lid member 88 and a rod 84. Rod 84 may extend from the center of lid member 88 to the exterior of case 20 via opening 82. Cap 85 may be attached to front face 102, such that sealing member 83 is sandwiched between cap 85 and the portion of air communication wall 199 defining opening 82. Each of cap 85 and sealing member 83 may have an opening formed therethrough. Rod 84 also may extend via the openings of cap 85 and sealing member 83.

Coil spring 86 may be configured to apply a biasing force to valve element 87 toward sealing member 83. Therefore, lid member 88 may contact sealing member 83 and may cover the opening of sealing member 83, such that fluid communication between the interior of ink chamber 100 and the exterior of case 20 via opening 82 and valve chamber 55 is prevented. When an external force is applied to rod 84 against the biasing force of coil spring 86, rod 84 may move toward valve chamber 55. Accordingly, lid member 88 of valve element 87 may move away from sealing member 83, and the opening of sealing member 83 may be uncovered. Consequently, fluid communication between the interior of ink chamber 100 and the exterior of case 20 via opening 82 and valve chamber 55 may be allowed. When this occurs, air may flow into ink chamber 100 via opening 82 and valve chamber 55, and the pressure in ink chamber 100 may become equal to the atmospheric pressure.

Referring to FIGS. 1(A)-2(B), when first cover 21 is in the first position, rod 84 may be positioned in the interior of first cover 21 away from front wall 161. When first cover 21 moves from the first position to the second position, rod 84 may contact front wall 161 and may be pressed toward valve chamber 55. When first cover 21 is in the second position, lid member 88 of valve element 87 may be positioned away from sealing member 83, and the opening of sealing member 83 may be uncovered.

When ink cartridge 10 is inserted into mounting portion 202, first cover 21 may contact a particular portion of mounting portion 202 and may be pressed against the particular portion of mounting portion 202, such that first cover 21 moves from the first position to the second position. When this occurs, rod 84 may be pressed by first cover 21, such that lid member 88 of valve element 87 moves away from sealing member 83, and the opening of sealing member 83 is uncovered. Consequently, fluid communication between the interior of ink chamber 100 and the exterior of case 20 via opening 82 and valve chamber 55 may be allowed. Moreover, referring to FIG. 8, cap 95 may emerge from the interior of first cover 21 to the exterior of first cover 21, and ink tube 49 may be inserted into opening 111 of cap 95. The outer diameter of ink tube 49 may be less than the diameter of opening 111.

When ink cartridge 10 is further inserted into mounting portion 202, ink tube 49 may be inserted into ink supply opening 91, and an end of ink tube 49 may contact second valve element 97. The diameter of ink tube 49 may be greater than the smallest diameter of ink supply opening 91. Therefore, when ink tube 49 is inserted into ink supply opening 91, sealing member 93 elastically may deform and contact the outer surface of ink tube 49 liquid-tightly. When ink cartridge 10 is further inserted into mounting portion 202, second valve element 97 may be pressed by ink tube 49 against the biasing force of coil spring 96, and may move away from sealing member 93. Accordingly, ink supply opening 91 may be uncovered. When this occurs, ink tube 49 may enable valve chamber 54 to be in fluid communication with the exterior of case 20 via ink supply opening 91 and opening 110, such that ink in the ink chamber 100 may be allowed to be supplied to the recording head via an ink path 120 extending via opening 28, opening 41, the opening of valve element receiving portion 39, valve chamber 54, and ink tube 49.

When ink cartridge 10 is inserted into and removed from mounting portion 202, ink may leak from end 133 of cap 155. Because ink holding spaces 180 are open at the first end of ink holding space 180, such ink may be held in ink holding spaces 180 by capillary force.

As described above, ink may be held in ink holding spaces 180 by capillary force. Accordingly, ink may be prevented from dripping from cap 95.

Because gravitational force acts on ink leaked from end 133 of cap 155, the ink may adhere to lower portion 149 of ink supply portion 160, however, because ink holding spaces 180 may be formed at lower portion 149, such ink may be prevented from dripping from cap 95.

When first cover 21 is in first portion, cap 95 may be positioned in the interior of first cover 21. Therefore, even if ink drips from cap 95, ink may be held inside first cover 21.

In another embodiment, cap 95 may not comprise wall 132, and outer surface 166 of first peripheral wall 126 may be flush with outer surface 127 of second peripheral wall 127.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. An ink cartridge comprising:

a case comprising:

an ink chamber configured to store ink therein; and a particular face facing an exterior of the case and having a first opening formed therethrough;

an ink supply portion extending from a particular portion of the particular face in a particular direction, wherein the particular portion surrounds the first opening, and the ink supply portion has a tube shape, wherein the ink supply portion comprises:

a particular chamber formed therein;

an end wall having a second opening formed therethrough; and a peripheral wall extending from the end wall, wherein the ink supply portion is configured to supply ink from the ink chamber to the exterior of the case via the particular chamber and the second opening; and a plurality of protrusions, wherein each of the plurality of protrusions extend from the peripheral wall in a corresponding radial direction with respect to the peripheral wall, and extends in an axial direction of the peripheral wall, wherein each corresponding radial direction is perpendicular to the axial direction of the peripheral wall, and the axial direction of the peripheral wall is parallel to the particular direction, wherein each adjacent pair of the plurality of protrusions defines an ink holding space therebetween, and the ink holding space has a first end and a second opposite the first end, wherein the first end is positioned closer to the end wall than the second end is positioned to the end wall, and the ink holding space is open at the first end.

2. The ink cartridge of claim 1, wherein the ink supply portion further comprises:

a particular wall extending from the particular portion of the particular face in the particular direction, wherein the particular wall comprises the particular chamber formed therein; and a cap comprising the end wall and the peripheral wall, wherein the peripheral wall surrounds at least a portion of the particular wall.

3. The ink cartridge of claim 1, wherein the ink supply portion further comprises a further wall extending from the peripheral wall in the radial directions of the peripheral wall and extending in a circumferential direction of the peripheral wall, and the further wall intersects the plurality of protrusions, such that the further wall defines the second end of the at least one ink holding space.

4. The ink cartridge of claim 1, wherein the plurality of protrusions comprise a first protrusion, a second protrusion positioned adjacent to the first protrusion, and a third protrusion positioned adjacent to the second protrusion, wherein a first ink holding space is formed between the first protrusion and the second protrusion, and a second ink holding space is formed between the second protrusion and the third protrusion, and the first ink holding space and the second ink holding space are aligned in a circumferential direction of the peripheral wall.

5. The ink cartridge of claim 1, wherein each of the plurality of protrusions comprise a base portion connected to the peripheral wall and an end surface opposite the base portion, and the end surface extends in the axial direction of the peripheral wall, wherein the end surfaces of the plurality of protrusions comprise a guide surface configured to guide the ink supply portion.

6. The ink cartridge of claim 1, further comprising:

a cover configured to cover a portion of the case, wherein the cover comprises a cover wall facing the particular face, and the cover wall has a cover opening formed therethrough; and at least one biasing member positioned between the cover wall and the particular face, wherein the cover is configured to move between a first position and a second position, and the cover wall is positioned closer to the particular face when the cover is in the second position than when the cover wall is positioned in the first position, wherein the ink supply portion is configured to be positioned in an interior of the cover when the cover is in the first position, and to be positioned outside the cover when the cover is in the second position, wherein the at least one biasing member is configured to bias the cover into the first position.

7. An ink cartridge comprising:

a case comprising:

an ink chamber configured to store ink therein;

a first face facing an exterior of the case and having a first opening formed therethrough;

a second face facing the exterior of the case and positioned opposite the first face;

a third face facing the exterior of the case and extending between the first face and the second face; and a fourth face facing the exterior of the case and extending between the first face and the second face, wherein the fourth face is positioned opposite the third face, and the first opening is positioned closer to the fourth face than the first opening is positioned to the third face;

an ink supply portion extending from a particular portion of the first face in a particular direction, wherein the particular portion surrounds the first opening, and the ink supply portion has a tube shape, wherein the ink supply portion comprises:

a particular chamber formed therein;

an end wall having a second opening formed therethrough; and a peripheral wall extending from the end wall, wherein the ink supply portion is configured to supply ink from the ink chamber to the exterior of the case via the particular chamber and the second opening; and a plurality of protrusions, wherein each of the plurality of protrusions extend from the peripheral wall in a corresponding radial direction with respect to the peripheral wall, and extend in an axial direction of the peripheral wall, wherein each corresponding radial direction is perpendicular to the axial direction of the peripheral wall, and the axial direction of the peripheral wall is parallel to the particular direction, wherein each adjacent pair of the plurality of protrusions defines an ink holding space therebetween, and the ink holding space has a first end and a second opposite the first end, wherein the first end is positioned closer to the end wall than the second end is positioned to the end wall, and the ink holding space is open at the first end and is positioned between the particular chamber and a plane on which the fourth face lies.

* * * * *